United States Patent [19]

Quack et al.

[11] Patent Number: 4,884,409

[45] Date of Patent: Dec. 5, 1989

[54] METHOD AND APPARATUS OF COOLING A TOROIDAL RING MAGNET

[75] Inventors: Hans Quack, Pfaffikon, Switzerland; Antonio Angelini, Ranco, Italy

[73] Assignee: Sulzer Brothers Limited, Winterthur, Switzerland

[21] Appl. No.: 301,631

[22] Filed: Jan. 25, 1989

[30] Foreign Application Priority Data

Feb. 12, 1988 [CH] Switzerland ..... 507/88

[51] Int. Cl.[4] ..... F25B 19/00

[52] U.S. Cl. ..... 62/51.1; 174/15.4; 335/300; 336/62

[58] Field of Search ..... 62/51.1; 335/300; 336/62; 174/15.4

[56] References Cited

U.S. PATENT DOCUMENTS 3,878,691 4/1975 Asztalos ..... 62/51.1
3,882,687 5/1975 Asztalos et al. ..... 62/51.1
4,692,560 9/1987 Hotta et al. ..... 62/51.1

FOREIGN PATENT DOCUMENTS 0122133 10/1984 European Pat. Off. .
0223868 6/1987 European Pat. Off. .
2521604 11/1976 Fed. Rep. of Germany .
1417110 12/1975 United Kingdom .

OTHER PUBLICATIONS

IEEE Transactions on Magnetics, vol. MAG.-17, No. 5, Sep. 1981, pp. 1878-1881.
IEEE Transactions on Nuclear Science, vol. NS-30, No. 4, Aug. 1983, pp. 2901-2903.

*Primary Examiner*—Ronald C. Capossela
*Attorney, Agent, or Firm*—Kenyon & Kenyon

[57] ABSTRACT

The torodial ring magnet is cooled by a gaseous cooling medium which is conducted through a first cooling circuit through the channels of the magnet coils of the magnet. The gaseous cooling medium exiting the magnet is cooled by a second liquid cooling medium in a second cooling circuit within an auxiliary cooler. Temperature sensors are provided to sense the temperature of the exiting gaseous cooling medium from the magnet sections to permit the opening or closing of a valve in the auxiliary cooler to cause the gaseous coolant to be cooled or not by the liquid cooling medium.

16 Claims, 1 Drawing Sheet

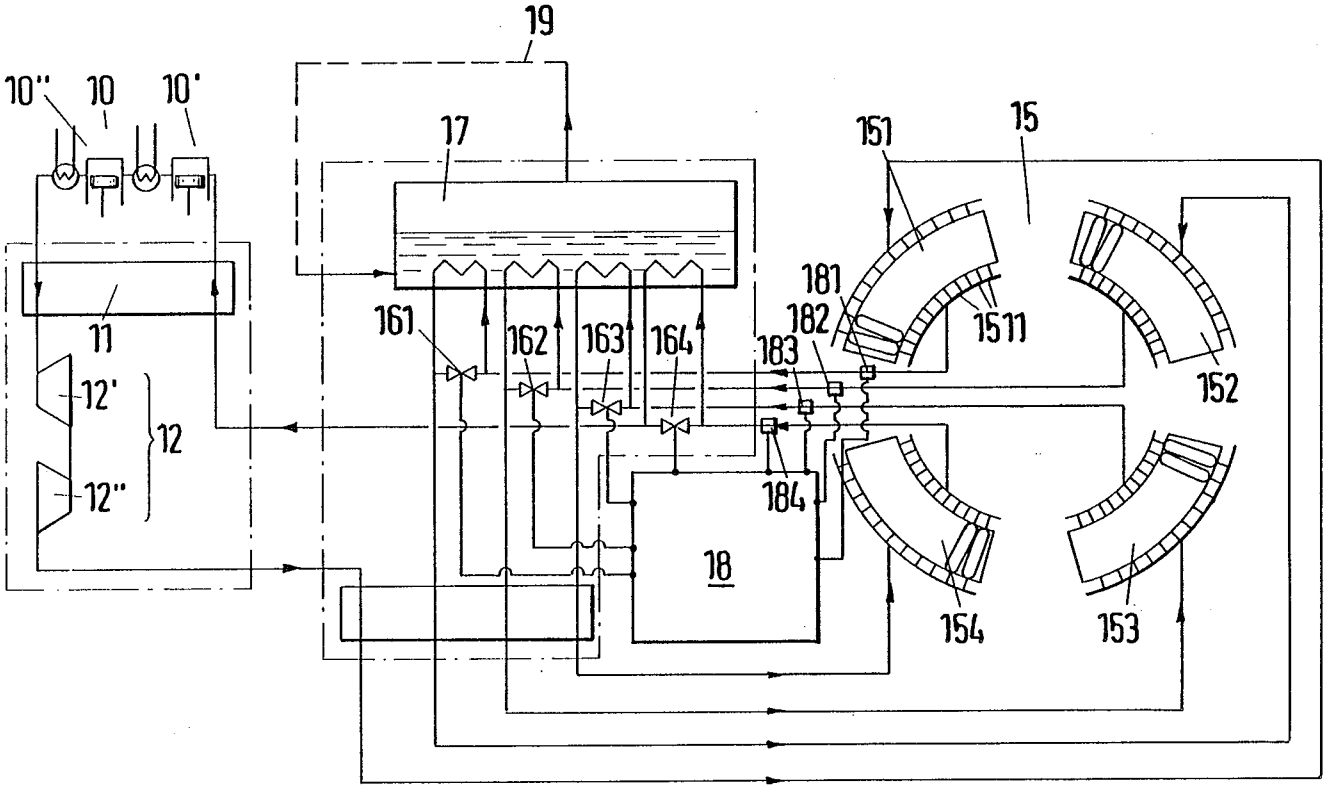
15
151
1511
152
153
154
181
182
183
184
18
164
163
162
161
17
19
10'
10
10''
11
12
12'
12''

METHOD AND APPARATUS OF COOLING A TOROIDAL RING MAGNET

This invention relates to a method and apparatus for cooling a toroidal ring magnet. More particularly, this invention relates to a method of cooling magnet coils operating in a pulsed manner. Still more particularly, this invention relates to a method and apparatus for cooling magnet coils capable of generating very strong magnetic fields.

Installations for generating very strong magnetic fields of for example, several teslas, as used inter alia in research installations in elementary particle research, low-temperature physics, fusion and plasma research, including in particularly so-called tokamak installations, are often operated at temperatures in the low-temperature range. A tokamak is a toroidal plasma machine where a very strong magnetic field, which is parallel to an annular plasma surface and hence also to the current in the plasma, has a stabilizing effect. With the tokamak, high inclusion times of high-temperature plasmas are achieved, as is sought in nuclear fusion. Typically, such tokamaks are pulsed during some few seconds, e.g. 3 to 4 seconds. The heat generated during each pulse may be in the range of perhaps 800 to 1000 MJ ((Mjoule).

Operation of such installations in the low-temperature range has the advantage that the coefficient of thermal expansion of copper of which the magnet coils are made, becomes smaller at these temperatures. Thus, the mechanical stress on the structure due to expansion upon heating is reduced. In pulsed operation, the coil of a tokamak can heat up by over 100° K.

At the same time, the electric conductivity of the copper improves with decreasing temperature, resulting in a desired lesser evolution of heat.

Installations using a pulsed operation, such as tokamaks, have until now been cooled, between the individual pulses, with liquid nitrogen to temperatures in the range of about 80° K. and to close to the freezing point of nitrogen of 63° K. Cooling of the nitrogen to approximately its freezing point is accomplished, for example, with helium.

Particulars on the cooling of tokamaks are found for example in the publication "Operational limits of an inertial cooled compact ignition experiment" by A. Angelini et al, after a paper read at the "Technical Committee Meeting and Workshop on Fusion Reactor Design and Technology, May 26 to June 6, 1986, in Yalta, USSR, or in Technical Note No. 1.87.150 PER 1359/87, of the Commission of the European Communities Joint Research Centre, ISPRA Establishment, "IGNITOR, Cooling of the Toroidal Magnet", A. Angelini, July 1987.

This type of cooling with liquid gas is, however, complicated inasmuch as before each pulse, the liquid coolant/cooling medium, i.e. the liquid nitrogen or other liquid gas, must be removed from the cooling channels, as otherwise the impermissibly high pressures resulting upon heating of the coolant would damage the installation. Besides, this type of cooling with nitrogen, the most cost-effective coolant, is limited to a theoretically lowest attainable temperature of 63.2° K., but in practice only about 70° K.

Other types of cooling circuits have been known for cooling various structures. For example, European Patent Application No. 0122133 describes a cooling arrangement for a central solenoid of a set of field coils for a medical N.M.R. As described, the solenoid may be maintained at a temperature by use of a high velocity primary cooling circuit and a low velocity secondary circuit connected in series with the main cooling circuit.

British Patent No. 1,417,110 describes a refrigeration apparatus employing a bypass arrangement for the coolant which is operated in response to the temperature of a load falling below a chosen refrigeration limit.

German O.S. No. 2521604 describes a refrigeration arrangement for cooling magnet coils.

European Patent No. 0223868 describes a refrigeration circuit utilizing helium.

IEEE Transactions on Magnetics, Vol. M.A.G. 17, No. 5, Sept. 19, 1981, I. Horvath, et al "The piotron at Sin-A large super conducting double torus spectrometer", pages 1878–1881 and IEEE Translations on Nuclear Science, Vol. M.S. 30, No. 4, Part 2, August 1983, D. P. Brown, et al "Helium refrigeration system for BNL colliding beam accelerator" (pages 2901–2903) each describe a helium refrigeration system for cooling magnets. In each case, the helium circuit is constructed to pass a flow of helium into heat exchange relation with the magnet construction.

Accordingly, it is an object of the invention to be able to cool a magnet coil operating in a pulsed manner with a gaseous cooling medium.

It is another object of the invention to provide an economical method for cooling magnet coils to temperatures in the range of the freezing point of nitrogen and lower.

It is another object of the invention to permit the cooling process of a tokamak to continue during pulsing.

Briefly, the invention provides a method and apparatus for cooling a toroidal ring magnet.

In accordance with the method, a flow of a gaseous cooling medium, such as helium, is first cooled. Thereafter, the cooled gaseous medium is passed in a first path of a cooling circuit into heat exchange relation with the magnet in order to cool the magnet. For example, the cooling medium is conducted through channels of the magnet. Thereafter, should the gaseous cooling medium temperature be above a predetermined level when the medium exits the magnet, the gaseous cooling medium is cooled in a second circuit to a lower temperature by means of a heat exchange with a liquid cooling medium such as a bath of liquid nitrogen. The gaseous medium is then passed through a second path into heat exchange relation with the gaseous cooling medium in the first path in order to cool the medium in the second path while heating the medium in the first path. Next, the medium in the second path is passed back into the magnet into heat exchange relation with the magnet in order to again cool the magnet.

The recycling of the cooling medium into the magnet may be repeated several times with each successive pass of the cooling medium being placed in heat exchange relation with the After cooling of the magnet, the cooling medium is recycled.

Should the gaseous cooling medium exit the magnet at a temperature below the predetermined value, the second cooling circuit is by-passed.

The apparatus in accordance with the invention includes a main cooler for cooling a flow of gaseous cooling medium, conduit means for passing the cooled medium in a first path into heat exchange relation with the magnet in order to cool the magnet and an auxiliary cooler for passing the cooling medium passing from the magnet through a second path into heat exchange relation with the cooling medium in the first path in order to cool the medium in the second path while heating the medium in the first path. In addition, conduit means are provided for passing the medium in the second path into heat exchange relation with the magnet in order to cool the magnet and conduit means are provided for passing the cooling medium from the magnet to the main cooler for recycling of the medium.

The auxiliary cooler includes a heat exchanger disposed across the paths of the cooling medium in order to effect the heat exchange as well as a cooling means and a valve in the second path connected in parallel with the cooling means. The valve serves to selectively pass the gaseous cooling medium from the magnet into the cooling means prior to passage through the heat exchanger of the auxiliary cooler. In this regard, the cooling means includes a bath of a liquid cooling medium such as a liquid gas for cooling of the gaseous cooling medium exiting from the magnet. This liquid cooling medium may, in turn, be cooled in a separate circuit.

The valve is actuated by means of a temperature sensor which senses the temperature of the gaseous cooling medium passing from the magnet such that the valve is closed in response to the temperature of the gas rising above a predetermined value, such as 70° K.

The invention thus provides a cooling method for magnet coils which operate in a pulsed manner for generating magnetic fields of very high strength wherein the coolant need not be removed from cooling channels within the magnet before each pulse. Further, the cooling process may continue even during a pulse. Further, the method permits an economical manner of cooling the magnet coils to temperatures in the range of the freezing point of nitrogen and lower.

These and other objects and advantages of the invention will become more apparent from the following detailed description taken in conjunction with the accompanying drawings wherein:

The FIGURE schematically illustrates a cooling apparatus for a toroidal ring magnet constructed in accordance with the invention.

As illustrated, the toroidal ring magnet 15 includes a plurality of disc-shaped copper coils forming magnet sections 151, 152, 153, 154 for generating a very strong magnetic field, The apparatus for cooling the magnet 15 includes a two stage compressor 10 having two stages 10', 10'' for compressing a gaseous cooling medium, such as helium at room temperature. In addition, the apparatus includes a main cooler having a counterflow heat exchanger 11 and a cooling means 12 in the form of two series-connected turbo-expanders (turbines 12', 12'' for cooling the helium compressed by the compressor cooled helium in a first path of a cooling circuit into heat exchange with the magnet 15 to cool the magnet 15.

In addition, the apparatus includes an auxiliary cooler 13 which contains, for example, a helium-helium heat exchanger 15 and a vaporizer 17 for a liquefied gas cooling medium such as liquid nitrogen.

As indicated, conduit means extend from each of the four magnet sections 151, 152, 153, 154 to the auxiliary cooler 13. In addition, the auxiliary cooler 13 is provided with a conduit for passing the helium passing from the first magnet section 151 through a second path into heat exchange relation with the helium in the first path extending from the main cooler in order to cool the medium in the second path while heating the medium in the first path. This conduit includes a valve 161 which is controlled electronically via a suitable line from an electronic control 18 so as to open and close. This valve 161 is connected in parallel with the liquid nitrogen vaporizer 17 (cooling means) for selectively passing the helium from the magnet section 151 into the vaporizer 17 prior to passage through the heat exchanger 14. In like manner, the auxiliary cooler has conduit lines connected to the conduit means from each of the remaining magnet sections 152, 153, 154 as well as valves 162, 163, 164 in each conduit line so that the helium from each respective magnet section 152, 153, 154 can be selectively passed into liquid nitrogen vaporizer 17 for cooling therein prior to passage through the heat exchanger 14 or exiting from the auxiliary cooler 13 to the main cooler.

Conduit means also connect the auxiliary cooler 13 on the outlet side to the respective magnet sections 152, 153, 154 so as to pass the helium into heat exchange relation with the magnet sections for cooling of the magnet 15.

As indicated, each conduit means extending from the magnet sections 151–154 contains a temperature sensor 181, 182, 183, 184, respectively for sensing the temperature of the helium exiting from the respective magnet section 151–154. Each sensor 181–184 is connected via a suitable line to the electronic control 18, which, in turn, is connected with the valves 161, 164 so that the respective valve may be closed in response to the temperature of the helium rising above a predetermined value.

As shown, the fourth conduit line in the auxiliary cooler 13 passes to the main cooler so as to pass the helium from the last magnet section 154 to the main cooler for recycling. In this respect, the helium is passed through the heat exchanger 11 prior to flow to the compressor 10.

In operation, helium at room temperature is first compressed in the compressor 10. The high pressure helium flow is then cooled in the main cooler by first passing through the counterflow heat exchanger 11 in heat exchange relation with the heated helium flowing from the magnet 15. Next, the helium is passed through the series connected turbo expanders 12', 12'' and further cooled by expansion. The cooled helium is then conducted through the heat exchanger 14 of the auxiliary cooler 13 wherein the helium heats up to some extent. The helium then flows to the first magnet section 151 and is conducted, for example through sixty parallel cooling channels of different ring magnet segments 1511. The segments are thus cooled and the heat is absorbed by the helium which is then returned by the conduit means to the auxiliary cooler 13.

If the helium issuing from the magnet section 151 has a temperature higher than, for example, 80° K., as sensed by the temperature sensor 181, the valve 161 is closed and the helium is conducted through the liquid nitrogen vaporizer 17 for cooling in the liquid nitrogen bath therein. The cooled helium is then passed into the heat exchanger 14 of the auxiliary cooler 13.

As illustrated, the liquid nitrogen of the vaporizer 17 may be cycled and cooled in a separate cooling system 19. This cooling system 19 may contain an independent nitrogen liquefier (not shown) or the nitrogen liquefier may be coupled with a helium liquefier.

In passing through the heat exchanger 14, the helium enters into a heat exchange relation with the helium passing from the main cooler. Thus, the helium from the main cooler is slightly heated while the helium from the magnet section 151 is slightly cooled. This latter cooled helium is then conveyed into the second ring section 152 for cooling of the segments therein.

The helium leaving the magnet section 152 is then conveyed through the auxiliary cooler 13 either directly through the heat exchanger 14 or through the vaporizer 17 and heat exchanger 14 depending on the temperature sensed and cycled into the magnet section 153.

The helium exiting the magnet section 153 is cycled through the auxiliary cooler 13 in like fashion prior to delivery to the final magnet section 154.

The helium exiting the final magnet section 154 may pass direcctly through the valve 164 to the heat exchanger 11 of the main cooler or may be passed through the vaporizer 17 prior to passage to the heat exchanger 11 of the main cooler depending upon the temperature sensed by the sensor 184.

In the example shown, the helium, having passed through all four magnet sections 151–154, returns to the two stage compressor 10. Upon return, the helium is again heated to room temperature in the heat exchanger 11.

As soon as the exit temperature of the helium is lower at all four sections 151, 152, 153, 154 than, for example, 70° K., the liquid nitrogen vaporizer 17 is completely by-passed and the helium is cooled only in the helium-helium heat exchanger 14 of the auxiliary cooler 13 and in the main cooler defined by the compressor-turbine system 10, 12. In this case, the nitrogen cooling system 17, 19, is no longer active and does not contribute to the cooling of the magnet 15. With such an arrangement, it is possible to cool a tokamak installation containing, for example, so-called Bitter coils, or coils of another type, having a mass of about 30 tons with cooling units of known type in about 70 to 100 minutes from, for example, about 170° K. to about 60° K.

In different modes of operation, one or more of the valves 161–164 may be closed, depending upon the exit temperature of helium from the magnet sections, so as to further cool the gaseous cooling medium by means of a liquid cooling medium, i.e. the liquid nitrogen bath in the vaporizer 17. In this respect, the gaseous cooling medium is selected from the group consisting of helium, neon, hydrogen and mixtures thereof. Further, the gaseous cooling medium is selected so as to have a higher boiling temperature than the liquid cooling medium and is circulated under a pressure of from 2 to 7 bars.

The use of a gaseous cooling medium for cooling the magnet permits the cooling medium to be passed through the magnet during pulsing of the magnet.

What is claimed is:

1. A method of cooling magnet coils operating in a pulsed manner, said method comprising the steps of cooling a flow of a first gaseous cooling medium;

passing the cooled first gaseous cooling medium into heat exchange relation with the magnet coils to cool said coils;

thereafter cooling the first gaseous cooling medium in heat exchange relation with a second cooling medium in a second cooling circuit;

passing the cooled first gaseous cooling medium into heat exchange relation with the magnet coils; and then re-cycling the first gaseous cooling medium.

2. A method of cooling a toroidal ring magnet comprising the steps of cooling a flow of a gaseous cooling medium;

passing the cooled gaseous cooling medium in a first path into heat exchange relation with the magnet to cool the magnet;

passing the gaseous cooling medium from the magnet into heat exchange relation with a second cooling medium to cool the gaseous cooling medium;

thereafter passing the gaseous cooling medium in a second path into heat exchange relation with the gaseous cooling medium in said first path to cool the medium in said second path while heating the medium in said first path;

passing the medium in said second path into heat exchange relation with the magnet to cool the magnet; and thereafter recycling the cooling medium.

3. A method as set forth in claim 2 wherein the helium, neon, hydrogen and mixtures thereof.

4. A method as set forth in claim 2 wherein the gaseous cooling medium circulates under a pressure of from 2 to 7 bars.

5. A method as set forth in claim 2 which further comprises the step of selectively by-passing the gaseous cooling medium from the magnet from heat exchange relation with said second cooling medium prior to passing into heat exchange with the gaseous cooling medium in said first path.

6. A method as set forth in claim 5 wherein said second cooling medium is a liquid gas.

7. A method as set forth in claim 6 wherein said liquid gas is nitrogen.

8. A method as set forth in claim 5 wherein the gaseous cooling medium in said first path has a higher boiling temperature than said second cooling medium.

9. A method as set forth in claim 2 wherein the ring magnet is pulsed and the gaseous cooling medium is passed into heat exchange with the ring magnet during pulsing.

10. In combination a toroidal ring magnet;

a main cooler for cooling a flow of gaseous cooling medium;

conduit means for passing the cooled gaseous cooling medium in a first path into heat exchange relation with said magnet to cool said magnet;

an auxiliary cooler including a cooling means for cooling the gaseous cooling medium passing from said magnet and a heat exchanger for passing the gaseous cooling medium through a second path into heat exchange relation with the gaseous cooling medium in said first path to cool the medium in said second path while heating the medium in said first path;

conduit means for passing the medium in said second path into heat exchange relation with said magnet to cool the magnet; and conduit means for passing the gaseous cooling medium from said magnet to said main cooler for recycling the medium.

11. The combination as set forth in claim 10 wherein said main cooler includes a heat exchanger for passing the cooling medium from said magnet in heat exchange relation with a compressed flow of gaseous cooling medium and at least one expansion turbine for expanding the compressed gaseous cooling medium downstream of said heat exchanger.

12. The combination as set forth in claim 11 wherein said heat exchanger of said auxiliary cooler is disposed across said first path and said second path.

13. The combination as set forth in claim 10 wherein said auxiliary cooler includes a valve in said second path connected in parallel with said cooling means for by-passing the gaseous cooling medium about said cooling means.

14. The combination as set forth in claim 13 wherein said cooling means includes a bath of liquid gas for cooling of the gaseous cooling medium from said magnet.

15. The combination as set forth in claim 13 which further comprises a temperature sensor for sensing the temperature of the cooling medium passing from said magnet into said second path and an electronic control connected between and to said sensor and said valve to close said valve in response to the temperature of the gas rising above a predetermined value.

16. The combination as set forth in claim 10 wherein said magnet includes a plurality of disc-shaped copper coils for generating a very strong magnetic field.

* * * * *

UNITED STATES PATENT AND TRADEMARK OFFICE

CERTIFICATE OF CORRECTION

PATENT NO. : 4,884,409

DATED : DECEMBER 5, 1989

INVENTOR(S) : HANS QUACK, et al

It is certified that error appears in the above-identified patent and that said Letters Patent is hereby corrected as shown below:

Column 2, line 58 "with the" should be -with the prior pass.-
Column 3, line 48 "field," should be -field, for example for use of the magnet 15 as a tokamak.-
Column 3, line 56 "compressor cooled" should be -compressor 10. Suitable conduit means are also provided for passing the cooled-
Column 6, line 19 "the he." should be -the cooling medium is a gas selected from the group consisting of helium-
Column 6, line 20, delete "lium".

Signed and Sealed this

Seventh Day of May, 1991

*Attest:*

HARRY F. MANBECK, JR.

*Attesting Officer*

*Commissioner of Patents and Trademarks*